United States Patent [19]

Tonomura

[11] 4,286,532

[45] Sep. 1, 1981

[54] SEWING MACHINE WITH A DEVICE FOR DIRECTLY DRIVING THE FEEDING SHAFT

[75] Inventor: Yoshinobu Tonomura, Hachioji, Japan

[73] Assignee: Janome Sewing Machine Co., Ltd., Tokyo, Japan

[21] Appl. No.: 955,478

[22] Filed: Oct. 25, 1978

[30] Foreign Application Priority Data

Apr. 6, 1978 [JP] Japan ..... 53/39749

[51] Int. Cl.[3] ..... D05B 27/00

[52] U.S. Cl. ..... 112/314

[58] Field of Search ..... 112/314, 303, 220, 277, 112/158 E, 121.11, 323

[56] References Cited

U.S. PATENT DOCUMENTS

| | | | |
|---|---|---|---|
| 2,690,724 | 10/1954 | Eisenbeiss | 112/323 X |
| 4,080,914 | 3/1978 | Ishida et al. | 112/314 X |
| 4,131,075 | 12/1978 | Wurst | 112/277 X |
| 4,142,473 | 3/1979 | Itoh | 112/158 E |
| 4,143,605 | 3/1979 | Soeda et al. | 112/158 E |

*Primary Examiner*—Peter P. Nerbun

*Attorney, Agent, or Firm*—Michael J. Striker

[57] ABSTRACT

The invention relates to a sewing machine and more particularly relates to a device for directly driving the fabric feeding shaft of the sewing machine independently of the upper main shaft and the lower loop taker drive shaft so as to secure a correct movement of the feeding shaft in a timed relation with the upper main shaft and the lower loop taker drive shaft for the purpose of avoiding the breakage of the needle and the formation of loosened stitches.

3 Claims, 9 Drawing Figures

1 : Machine controller
2 : Upper shaft drive circuit
3 : Upper shaft drive motor
4 : Upper shaft sensor
5 : Upper shaft potentiometer A
6 : Upper shaft stop ordering device
7 : Counter
8 : Feed shaft drive servo motor
9 : Feed shaft sensor
10 : Feed shaft potentiometer B
11 : Feed shaft stop ordering device
12 : Feed shaft counter
13 : Feed shaft drive circuit
14 : Manually operated ordering device

SEWING MACHINE WITH A DEVICE FOR DIRECTLY DRIVING THE FEEDING SHAFT

BACKGROUND OF THE INVENTION

In the prior art there have been many problems caused by the erroneous phasic movements of the fabric feeding device in a course of stitching operation by a sewing machine. For example, one of the problems is a phenomenon of loosened stitches which are formed when the feeding device initiates to feed the sewn fabric before the thread tightening is completely made by the thread taken up lever. Another of the problems is a phenomenon of needle breakage caused when the needle comes down to the sewn fabric before the fabric feeding is completely finished especially when a thick fabric is sewn. Such phenomena are essentially due to the fact that the timing movement of the feeding device in relation to the upper main shaft is caused by a cam mounted on the feeding shaft. In other words, there is a limit to the pressure angle of the cam, and it is also mechanically difficult to change the speed of angular movement of the feeding shaft independently. Such a mechanism, if any, will often produce an accumulated error in the movement transmission due to the complex structure. Moreover if wear is produced in such a complex structure, such wear will further increase the error in the feeding movement transmission, in effect to produce deformed or unbalanced patterns.

SUMMARY OF THE INVENTION

This invention has been provided to eliminate the abovementioned defects and disadiantages of the prior art. It is a primary object of the invention to directly drive the fabric feeding shaft independently of the upper main shaft and the lower loop taker drive shaft so as to secure a properly timed movement of the feeding shaft.

It is another object of the invention to hold the needle bar in the upper position where the needle is spaced from the sewn fabric until the feeding device feeds the fabric for a predetermined amount under the presser foot, so as to obtain ornamental stitches and basting stitches.

The other features and advantages of the invention will be apparent from the following description of the invention in reference to the attached drawings.

DETAILED DESCRIPTION OF THE INVENTION

Figure 1:
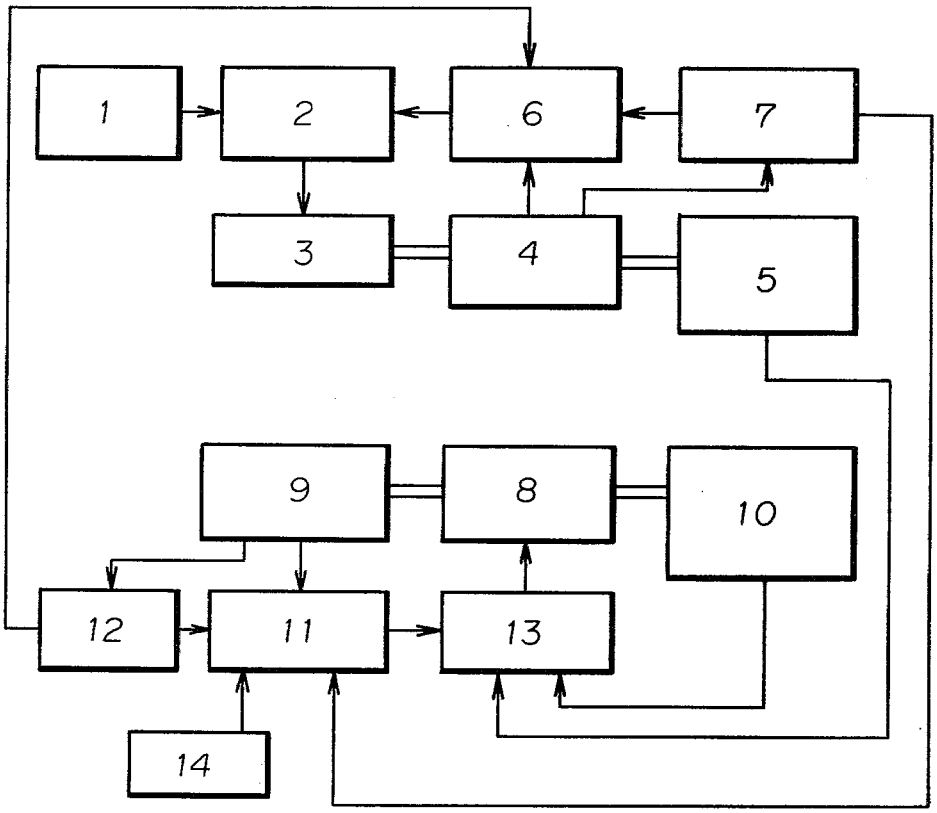
FIG. 1 shows a block diagrammatic representation of the invention.

In FIG. 1, the reference numeral 1 denotes a machine controller connected to an upper shaft drive motor 3 via an upper shaft drive circuit 2. The drive motor 3 is mechanically connected to an upper shaft of the sewing machine which has a sensor 4 and a potentiometer 5 mounted thereon for rotation therewith. The sensor 4 produces a pulse signal each time when the upper shaft comes to a predetermined angular position, and the potentiometer 5 produces signals indicating the angular positions of the upper shaft.

The sensor 4 gives a pulse signal to an upper shaft stop ordering device 6 and a counter 7 in each rotation of the upper shaft. The drive motor 3 is subject to a speed control by operation of the controller 1 as known, and also receives a stop order from the upper shaft stop ordering device 6 to stop the rotation of the upper shaft at a predetermined angular position thereof. The drive motor 3 also stops the rotation of the upper shaft after the counter 7 has counted a predetermined number of rotations of the upper shaft, namely a predetermined number of stitches. The reference numeral 8 denotes a servo motor for swingably driving a fabric feeding shaft. The servo motor 8 is mechanically connected to a sensor 9 and a potentiometer 10. The sensor 9 produces a pulse signal each time when the feeding shaft swingably comes to a predetermined angular position. The potentiometer 10 produces pulse signals indicating the predetermined angular positions of the feeding shaft.

The sensor 9 gives a pulse signal to a counter 12 and a feed shaft stop ordering device 11 each time when the feeding shaft makes one complete reciprocation. The servo motor 8 stops the feeding shaft at a predetermined angular position thereof by way of the stop ordering device 11. The servo motor also stops the feeding shaft after the counter 12 counts a predetermined number of feeding movements of the feeding shaft. The potentiometers 5, 10 are connected to a feed shaft drive circuit 13 which compares the signals from these potemtiometers to drive the feeding shaft control servo motor 8 in connection to the rotational angular positions of the upper shaft drive motor 3. The upper shaft stop ordering device 6 receives signals from the counter 12 to stop the upper shaft until the fabric feeding device feeds the fabric for a predetermined amount. On the other hand, the feeding shaft stop ordering device 11 receives the signals from the counter 7. The reference numeral 14 is a manually operated ordering device which gives an output to the feeding shaft stop ordering device 11.

Figure 2:
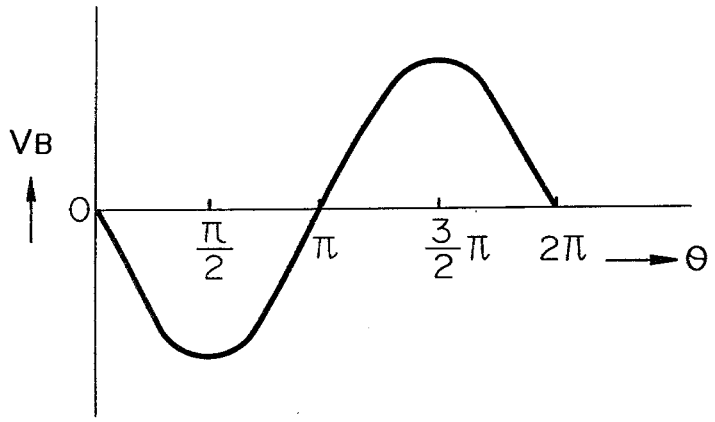
FIG. 2 shows an output potential in relation to the rotation angles of a potentiometer mounted on the upper main shaft of the sewing machine.
Figure 3:
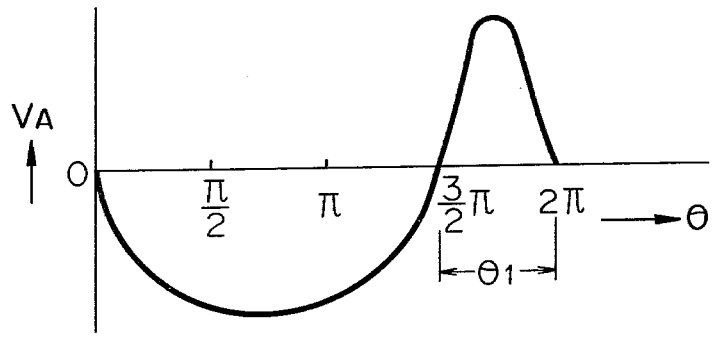
FIG. 3 shows an output potential in relation to the rotation angles of the potentiometer mounted on the upper main shaft of the sewing machine.

FIG. 2 shows an output voltage $V_B$ of the potentiometer 10 generated at the rotation angles $\theta$ thereof which is called potentiometer B in this case and is mounted on the servo motor 8 for driving the feeding shaft. The output voltage $V_B$ shows one period of symmetrical sine curve per rotation of the servo motor 8. FIG. 3 shows an output voltage $V_A$ of the potentiometer 5 at the rotation angles $\theta$ thereof which is called potentiometer A and is mounted on the upper shaft driven by the machine drive motor 3. The sine curve of the output voltage $V_A$ is, as shown, asymmetrical in the plus and minus ranges and is relatively larger in the minus range and smaller in the plus range. However, these voltages of the potentiometers 5, 10 are same in the maximum and minimum values. Namely the upper shaft and the feeding shaft are rotated from the rest point 0 with the same angular speed $\omega_A$, the output voltages $V_A$, $V_B$ take minus values respectively and the voltage $V_B$ is faster than the voltage $V_A$ to reach the next potential 0.

Now the purpose of the invention is to set the voltage $V_B$ to be always in accord with the voltage $V_A$ by controlling the speed of the feeding shaft control servo motor 8. In other words, the purpose of the invention is to set the voltage $V_B$ to reach the next potential 0 together with the voltage $V_A$ by driving the feeding shaft with the angular speed $\omega_A$ slower than that $\omega_A$ of the upper shaft.

Figure 4:
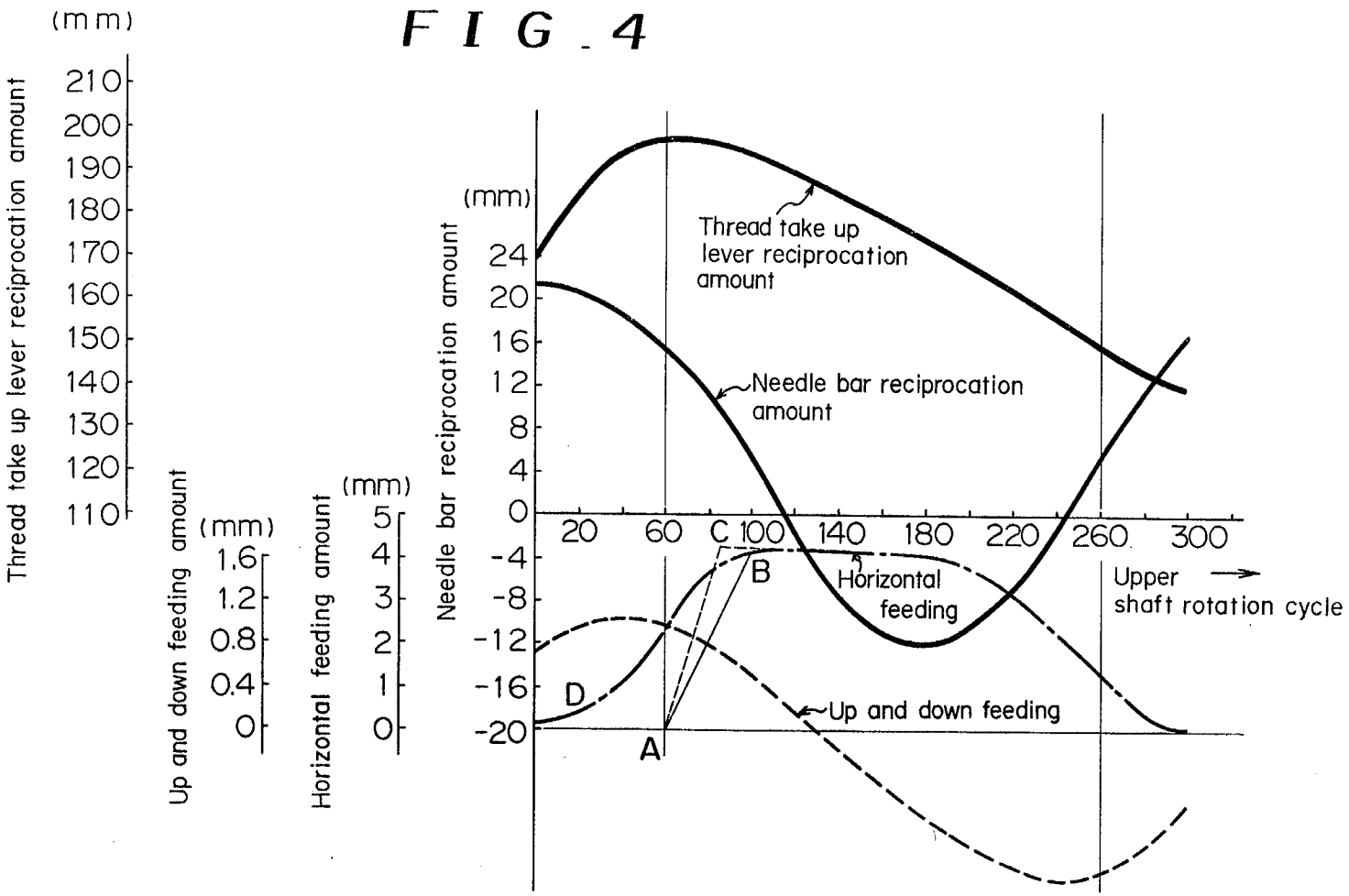
FIG. 4 shows the motion diagrams of the main parts of the sewing machine according to the invention.

FIG. 4 shows a motion diagram of the sewing machine parts. It is desirable to feed the sewn fabric in the horizontal direction immediately after the thread fastening has been made at the point A by the thread take up lever and to finish the horizontal feeding at the point B just before the needle penetrates the fabric. However, actually the horizontal feeding has been initiated at the point D due to the reason as stated in the preamble hereinbefore. In case the sewn fabric is thicker, it is desirable to shift the point B toward the point C in proportion to the thickness of the fabric. Namely by setting the feeding curve connecting the points A and C, the feeding device becomes ideal for feeding the thick or thin fabrics. It has been impossible to obtain such an inclination. But by driving the feeding shaft by a separate drive source independently of the upper main shaft and the lower loop taker drive shaft, and by properly adjusting the angular speed of the feeding shaft, a suitable feeding device can be attained for any kind of fabrics to be sewn. Thus the defects and disadvantages of the prior art can be eliminate.

In FIG. 3, $\theta_1$ is a range which corresponds to the range A-B or A-C in FIG. 4 in which the horizontal feeding should be applied with an increased angular speed of the feeding shaft. Namely the voltage $V_A$ in the plus side is designed to control the feeding shaft drive servo motor to be driven with an angular speed faster than that $\omega_A$ of the upper main shaft, so that, for example, the horizontal feeding may be finished in the range A-C in FIG. 4.

In this invention, the counters 7, 12 and the stop ordering devices 6, 11 may be replaced by a micro computer. In order to set the rotation of the feeding shaft drive servo motor substantially in accordance with a desired wave form such as shown in FIG. 3, it is possible to properly divide the wave form with respect to the axis $\theta$ and to store the voltages $V_A$ into a memory and then to read out these voltages one by one.

Figure 5:
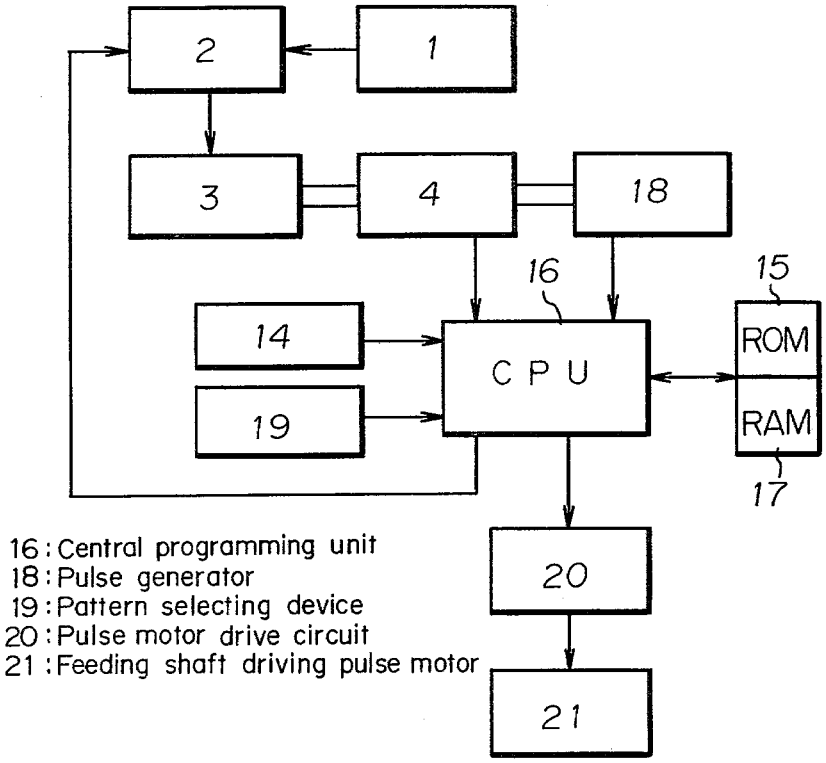
FIG. 5 shows a block diagrammatic representation according to the second embodiment of the invention.
Figure 6:
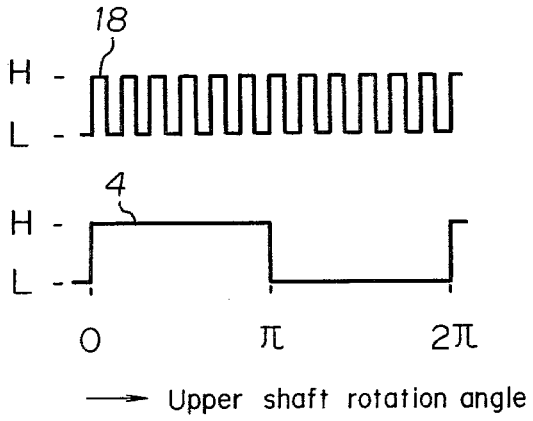
FIG. 6 shows an explanatory representation of signals in the embodiment shown in FIG. 5.

FIG. 5 shows another embodiment of the invention in which a micro computer is used as a main control device for controlling the operation of the feeding shaft, and a pulse motor is used for driving the feeding shaft. ROM 15 is a read only electronic memory storing stitch control signals and program control signals. CPU 16 is a central programming unit for ordering a signal readout, making program control and procesing a signal operation. RAM 17 is an electronic memory which is operated by the order of the CPU to store the data of the memory 15, the data necessary for various operation processes and the results of the operation processes. These memories 15, 17 and the CPU 16 constitute a micro computer. A pulse generator 18 and a sensor 4 on the upper shaft generate pulses respectively per rotation of the upper shaft. As shown in FIG. 6, the sensor 4 generates a pulse signal of high (H) and low (L) level with the same width per rotation $2\pi$ of the upper shaft. On the other hand the pulse generator 18 generates a plurality of pulses dividing the pulse of the sensor 4 with an equal width. In this case, the pulse generator 18 has angular positions to generate pulses each corresponding to the changeover of the H and L level of the pulse of the sensor 4. The changeover point 0 or $2\pi$ from the L level to the H level and the changeover point $\pi$ from the H level to the L level correspond respectively to the upper dead point of the needle bar (rotation angle 0° of the upper shaft) and the lower dead point of the needle bar rotation angle 180° of the up upper shaft as shown in FIG. 4.

A pattern selecting device 19 is provided on the front face of the sewing machine and is manually operated by way of switches to produce a specific code signal to the selected pattern. A pulse motor drive circuit 20 receives a control signal processed by the CPU 16 in dependence upon the signals from the pattern selecting device 19 and the manually operated ordering device 14, to control the operation of the feeding shaft driving pulse motor 21 in a specific angular phase of the upper shaft. The ROM 15 stores the data which are read out by the pattern selecting device 19 and the manually operated ordering device 14 to set the initial horizontal feeding point A and the feed ending point B. The angular phase of the upper shaft for drivingly controlling the pulse motor 21 is determined by the central programming unit (CPU 16) which discriminates the H and L levels of the pulse of the sensor 4 and also counts the pulses of the pulse generator 18 from the changeover point from L level to H level or from H level to L level. The drive speed and the drive amount of the feeding shaft can be determined by the total number of pulse motor driving pulses derived from the pulse motor drive circuit 20 and applied to the appointed individual pulses of the pulse generator 18. Such a number of pulse motor driving pulses is sought by the result of the operation processing made by the CPU 16 in dependence upon the inclination of the straight line connecting the points A and B and the horizontal feeding amount as shown in FIG. 6.

FIG. 5 does not include the upper shaft stop ordering device 6, the upper shaft counter 7, the feeding shaft stop ordering device 11 and the feeding shaft counter 12 which are all provided in FIG. 1. Instead, FIG. 5 includes a micro computer such as the central programming unit (CPU 16) housing all functions of these mentioned elements and is capable of control operation in the same way as the embodiment in FIG. 1.

Figure 7:
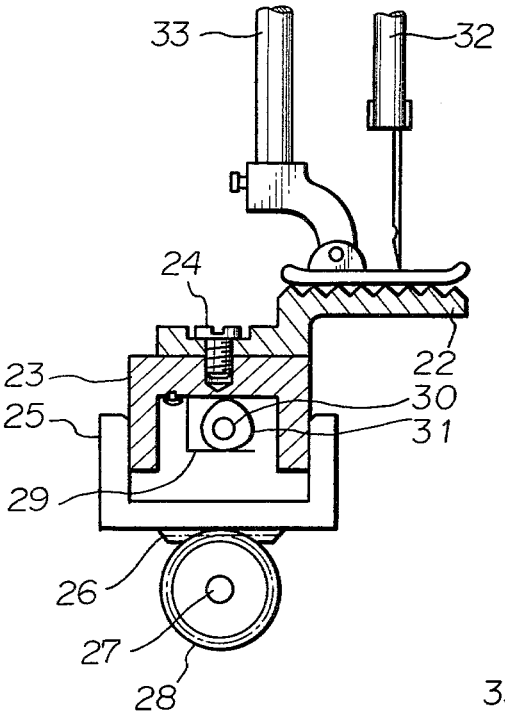
FIG. 7 shows a mechanical structure of the invention.

FIG. 7 shows a feeding mechanism operated by the feeding shaft driving device of the invention. The reference numeral 22 is a feed dog fixedly mounted on an up and down moving base 23 by means of a fastening screw 24. The reference numeral 25 is a U-shaped horizontal feeding member receiving the up and down moving base 23 and provided with a rack 26 at the bottom bace thereof. The rack 26 is engaged by a pinion 28 mounted on the swingable horizontal feeding shaft 27 so that the horizontal feeding member 25 may be moved in the right and left directions in FIG. 7 when the shaft 27 is swingably moved. The base 23 is received in the horizontal feeding member 25 and movable up and down. An auxiliary plate 29 is arranged in the horizontal feeding member 25 and supports the base 23. A triangular cam 31 is arranged between the base 23 and the auxiliary plate 29. The triangular cam 31 is mounted on an up and down feeding shaft 30 which is rotated by the upper main shaft in synchronism therewith. The base 23 is, therefore, moved up and down as the triangular cam 31 is rotated together with the shaft 30. The horizontal feeding shaft 27 is swingably driven by the servo motor 8 in FIG. 1 or by the pulse motor 21 in FIG. 5. The reference numeral 32 is a needle bar with a needle, and the reference numeral 33 is a presser bar with a presser foot which cooperates the feed dog 22.

Figure 8:
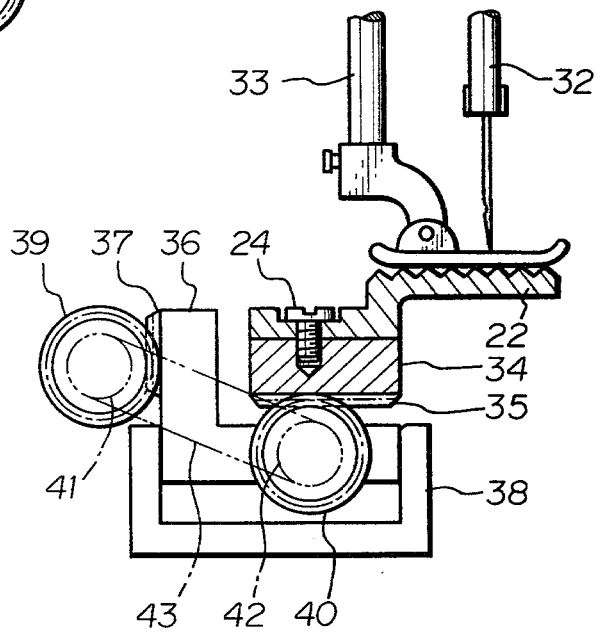
FIG. 8 shows a second mechanical embodiment of the invention.

FIG. 8 shows another embodiment to operate the feed dog 23 directly by using pulse motors. In this embodiment, the feed dog 22 is secured to a horizontal feeding base 34 by means of a screw 24. The reference numeral 36 is an L-shaped member received in a U-shaped guide 38 and movable up and down therein. The horizontal feeding base 34 is provided with a rack 35 at the bottom thereof which is engaged by a pinion 40 driven by a pulse motor (not shown) by way of belt wheels 41, 42 and a timing belt 43, thereby to move the feeding base in the right and left directions as the pinion 40 is driven. On the other hand, the L-shaped member 36 is provided with a rack on one side thereof which is engaged by a pinion 39 driven by another pulse motor (not shown), thereby to move the member 36 up and down in the guide 38 as the pinion 39 is driven. Therefore with a controlled and combined turning movements of the pinions 39, 40, the feed dog 22 can be variously set to feed the sewn fabric.

Figure 9:
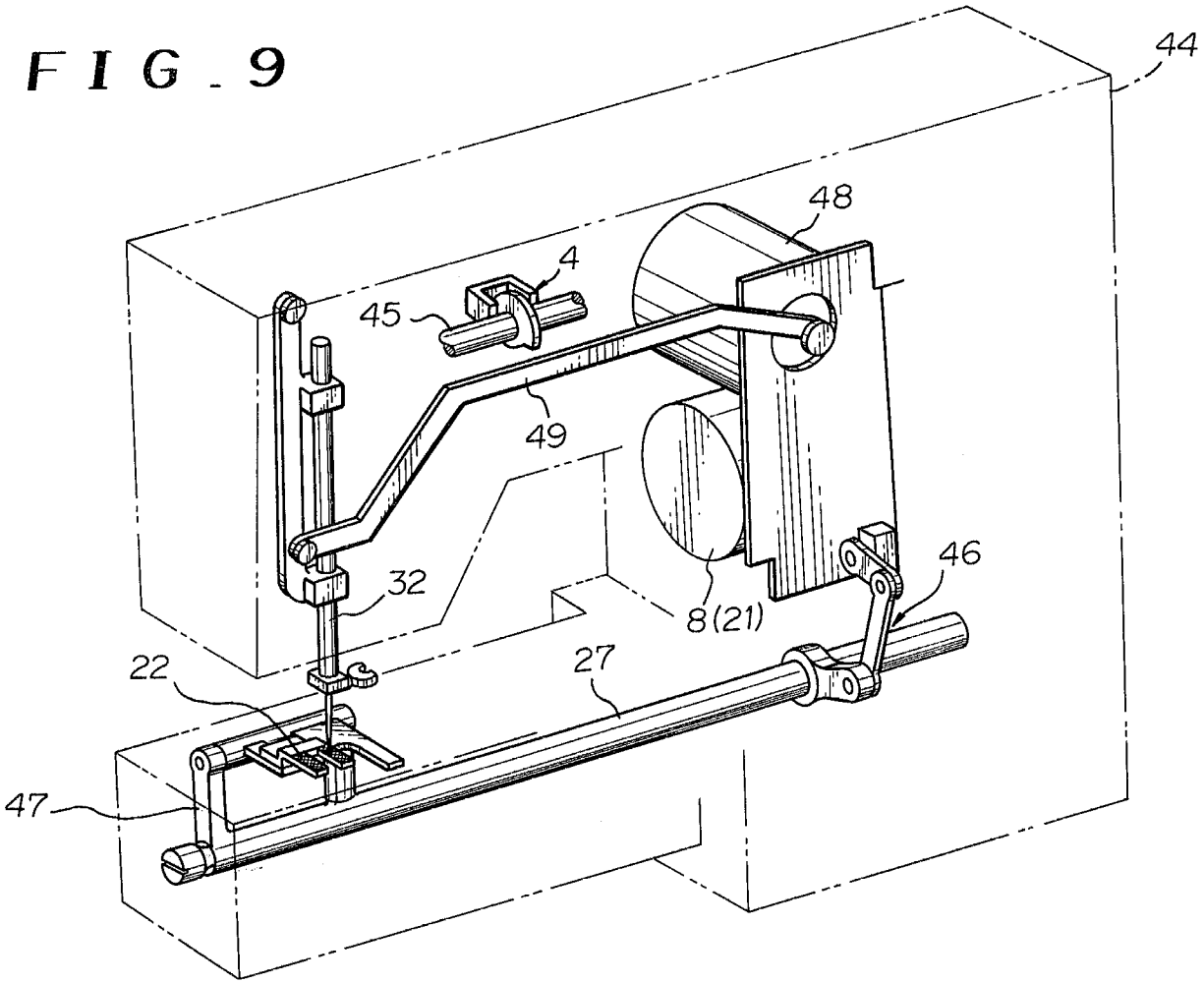
FIG. 9 shows an outlined perspective view of the sewing machine provided with the invention.

FIG. 9 is an outlined view of a sewing machine of the invention which is to be considered in connection with the embodiment in FIG. 7. The reference numeral 44 is a machine housing. 45 is the upper main shaft and 4 is the sensor cooperating with the upper shaft to generate a pulse per rotation of the upper shaft as mentioned herein-before. The pulse generator 18 in FIG. 5 is to be mounted on the upper shaft 45. The servo motor 8 or the pulse motor 21 swingably drives the horizontal feeding shaft 27 by way of a swingable linkage 46 as shown. The horizontal feeding shaft 27 reciprocates the feed dog 22 in a horizontal plane. In this case, the feed dog 22 is moved up and down in timed relation with the rotation of the upper shaft 27 by the cam 31 as shown in FIG. 7. A pulse motor 48 is connected to a transmission rod 49 at one end thereof which is connected at the other end to swingable from supporting the needle bar 32 for vertical reciprocation. The pulse motor 48 laterally reciprocates the transmission rod 49, thereby to reciprocate the swingable frame laterally of the fabric feeding path. According to the embodiment in FIG. 8, it will be apparent that the upper shaft can be stopped with the needle bar held in the upper dead point while the feed dog 22 is operated to feed the sewn fabric for the purpose of forming ornamental or basting stitches, since the feed dog 22 is operated by a drive source completely separate from the drive source of the upper shaft of the sewing machine.

Moreover according to the invention, since the horizontal feeding shaft for moving the feed dog 22 in a horizontal plane is driven by a drive source separate from the drive source of the upper shaft, it is possible that the feed dog 22 can be rapidly and positively operated to feed the sewn fabric at a proper time during one rotation of the upper shaft. Further in the embroidery stithching operation, the horizontal feeding shaft and the up and down shaft can be stopped at a predetermined angular position thereof so as to hold the feed dog 22 inoperative below the needle plate (not shown). The embodiments of the invention are all simple and compact, and require no conventionnally used transmission elements. Therefore there will be no accumulated errors which may be caused due to such conventional transmission elements and the abrasion thereof.

I claim:

1. In a sewing machine with a reciprocating needle, a needle plate and a feed dog, an improvement designed to eliminate loose stitches and needle breakage caused by lack of synchronization between needle movement and fabric feed, comprising: a first drive motor mechanically connected to the needle to vertically reciprocate the needle when the first drive motor is operated; a second drive motor mechanically connected to the feed dog to operate the feed dog when the second drive motor is operated; a microcomputer cooperating with the first and second drive motors to synchronize needle reciprocation and feed dog operation while the first and second drive motors are operated; and a first pulse generator and a second pulse generator, the first pulse generator cooperating with the first drive motor to produce a pulse signal with a first logical state when the needle is moving upwardly and with a second logical state when the needle is moving downwardly, and the second pulse generator cooperating with the first drive motor to produce a pulse train which is in phase with and subdivides the pulse signal into a plurality of subintervals, the first and second pulse generators cooperating with the microcomputer, whereby the microcomputer can synchronize operation of the first drive motor and second drive motor in dependence upon needle position and motion.

2. The improvement defined by claim 1, wherein the second drive motor is a pulse motor.

3. The improvement defined by claim 1, wherein the micro-computer is user-programmable to vary initiation and ending of fabric feed by the feed dog in accordance with fabric thickness.

* * * * *